US006248183B1

(12) United States Patent
Sampath, Jr.

(10) Patent No.: US 6,248,183 B1
(45) Date of Patent: Jun. 19, 2001

(54) NON-CHROMATE CONVERSION COATINGS FOR ALUMINUM AND ALUMINUM ALLOYS

(75) Inventor: Krishnaswamy Sampath, Jr., Johnstown, PA (US)

(73) Assignee: Concurrent Technologies Corporation, Johnstown, PA (US)

( * ) Notice: Subject to any disclaimer, the term of this patent is extended or adjusted under 35 U.S.C. 154(b) by 0 days.

(21) Appl. No.: 09/104,481

(22) Filed: Jun. 25, 1998

Related U.S. Application Data

(60) Provisional application No. 60/051,100, filed on Jun. 27, 1997.

(51) Int. Cl.[7] ..... C23C 22/05

(52) U.S. Cl. ..... 148/273; 148/275; 148/276

(58) Field of Search ..... 148/247, 261, 148/270, 272, 273, 275, 276, 280; 428/472.2

(56) References Cited

U.S. PATENT DOCUMENTS

| | | | | |
|---|---|---|---|---|
| 2,723,952 | | 11/1955 | Evangelides . | |
| 2,785,098 | * | 3/1957 | Cunningham et al. | 148/272 |
| 5,192,374 | * | 3/1993 | Kindler | 148/273 |
| 5,279,649 | * | 1/1994 | Stetson et al. | 148/261 |
| 5,378,292 | | 1/1995 | Miller et al. . | |
| 5,399,210 | | 3/1995 | Miller . | |
| 5,451,271 | | 9/1995 | Yosida et al. . | |
| 5,468,307 | | 11/1995 | Schriever . | |
| 5,500,288 | | 3/1996 | Isobe et al. . | |
| 5,595,611 | | 1/1997 | Boulos et al. . | |

FOREIGN PATENT DOCUMENTS

| | | | |
|---|---|---|---|
| 408144063A | * | 6/1996 | (JP) . |

* cited by examiner

*Primary Examiner*—John Sheehan
*Assistant Examiner*—Andrew L. Oltmans

(57) ABSTRACT

A method and solution for forming a non-chromate conversion coating on an aluminum substrate. The invention was developed to replace the potentially toxic chromic acid process. The method provides a conversion solution capable of substituting a select set of metallic ions for the aluminum ions of the gel formed on the substrate, wherein the metallic ions have ionic radii differing less than 35% of the aluminum ion radii and where the coordination numbers of the respective ions remain the same. The preferred substituting metal ion of the invention is manganese. Manganese was found to be a close match to both the ionic radii and coordination numbers of the aluminum ions to be replaced.

11 Claims, No Drawings

NON-CHROMATE CONVERSION COATINGS FOR ALUMINUM AND ALUMINUM ALLOYS

This application claims the benefit of U.S. Provisional Application No. 60/051,100, filed Jun. 27, 1997.

BACKGROUND

Chromate conversion coatings are widely used in the manufacture, repair, and refurbishment of a large number of engineering components for military and civilian applications. These surface coatings resist corrosion and promote paint adhesion. Such protective coatings are applied to a variety of substrate metals and alloys, most notably aluminum. Conversion coatings are produced by either immersion (dipping), spraying, swabbing, or brushing techniques that contain chromates and dichromates in the processing solution. Occasionally, electrolytic methods are used to obtain conversion coatings, but such methods require a great deal of maintenance and are impractical for recoating parts in the field.

Chemical conversion coatings are formed by a chemical reaction causing the surface of the metal to be converted into a tight adherent coating, all or part of which consists of an oxidized form of the substrate metal. The coating can provide high corrosion resistance as well as strong anchoring for paint. The industrial application of paint (organic finishes) to metals generally requires the use of a chemical conversion coating as a base coating, particularly when the performance demands are high.

Although aluminum protects itself against corrosion by forming a natural oxide coating, the protection is not complete. In the presence of moisture and electrolytes, aluminum alloys, particularly the high-copper aluminum alloys, corrode much more rapidly than pure aluminum. Thus, there is a need to treat aluminum with some form of beneficial conversion coating.

Generally two types of conversion coating processes are used in treating aluminum. The first is by anodic oxidation (anodization) in which the aluminum component is immersed in a chemical bath, such as a chromic or sulfuric acid bath, and an electric current is passed though the aluminum component and the chemical bath. The resulting conversion coating on the surface of the aluminum component offers resistance to corrosion and a bonding surface for organic finishes.

The second type of process chemically produces a conversion coating by subjecting the aluminum surface to a chemical solution, but without the use of electric current. This process is commonly referred to as a chemical conversion coating. The chemical solution can be applied by using immersion or spray application and is followed by drying. When dried, the coating which is initially gelatinous (gel) hardens, and becomes hydrophobic (less soluble in water) and more resistant to abrasion. The resulting conversion coating on the surface of the aluminum component offers resistance to corrosion and a bonding surface for organic finishes, such as a paint top coat.

Commonly, a chromate conversion coating solution containing chromium ions in the hexavalent [Cr(VI)] and trivalent [Cr(III)] state is used to produce a chemical conversion coating. The Cr(VI) is partially reduced to Cr(III) during the reaction, with a concurrent rise in pH. The chemical composition of the surface coating is indefinite as it contains varying amounts of reactants, reaction products, water of hydration and other anions, such as fluorides, and phosphates. When hexavalent Cr (VI) ions are incorporated into a coating, the ions leach out when in contact with a moisture and thereby provide corrosion resistance and also impart paint adhesion properties to the coating. However, solutions containing chromium ions in the hexavalent state have been determined to be carcinogenic. The U.S. Environmental Protection Agency (EPA) has included chromium on the list of toxic chemicals for "voluntary" replacement, and has promulgated strict waste disposal standards to curtail its use.

Strict waste disposal standards and chromium's listing as a toxic chemical have created a need for alternative chemical conversion coating compounds that do not contain the Cr(VI) ion. For such a compound to be accepted as an alternative it must meet or exceed the protective properties displayed by the chromium compounds. An alternative must also be capable of being used as a substitute with very little modifications to the present process so that it is readily accepted. An alternative providing protection comparable to that of chromium without being toxic is needed.

SUMMARY OF THE INVENTION

The conversion coatings of the present invention are able to replace the currently used chromate conversion coatings without significantly altering the current methods of coating. Chromate conversion coatings are valued because they provide corrosion resistance and improved paint adhesion. During chromate coating the chromium ions, Cr(III) and Cr(VI) form precipitates that also replace the metallic cations of the substrate gel. The Cr(III) ion is thought to allow for the hardening of the gel. The Cr(VI) ion leaches out when in contact with moisture, and thereby improves the corrosion resistance and promotes self-healing when defects are introduced into the coatings. The present invention is able to provide acceptable substitute metal ions to replace the Cr(III) and Cr(VI) ions without the need for added steps or equipment.

The present invention uses a series of steps that do not substantially alter the steps currently used to produce a conversion coating on aluminum and aluminum alloy substrates. These steps include: cleaning, desmutting, steaming, conditioning, conversion coating, and sealing. Other intermediate steps may be used such as rinsing in deionized water and drying. Basically, a gel is formed on the clean surface of the substrate and then the metal ions of the gel are substituted with another metal ion having a similar atomic radius and coordination number. Once the conversion coating is formed on the substrate, subsequent inorganic or organic coatings can be applied to the coating.

Cleaning is the first step in the preparation of the aluminum surface before conversion coating. During this step organic contaminants on the surface are removed using high pH (alkaline) soluble salts. The alkaline cleaner usually contains inhibitors because aluminum is easily corroded by alkaline solutions. After cleaning, the aluminum substrate is dipped or sprayed with a deoxidizer. The deoxidizer is commonly made up of either a mixture of nitric and hydrofluoric acids, or compounds such as ferric salts, persulfates and peroxides. The deoxidizer removes any remaining surface oxides on the aluminum. The deoxidized substrate is then immersed in boiling or near boiling deionized water to form a hydrated oxyhydroxide gel on the surface of the substrate (referred to in the industry as "steaming" the substrate).

The gel coated aluminum is placed in a conversion coating bath. Once in the bath the aluminum ions of the gel are exchanged for the metal ions contained in the conversion bath solution. Manganese cations are the preferred metal ions used in the conversion process due to the ions having a similar ionic radius to that of the aluminum ion. The conversion coating bath also reacts with the aluminum substrate. The Mn (VI) ions are partially reduced during the reaction with a concurrent rise in pH. This reaction forms a uniform coating consisting of a hydrated precipitate. The aluminum substrate may be removed from the conversion coating bath once the conversion process is complete. The substrate can then be dried, sealed in a sealant bath, or prepared for final painting of a top coat. A non-rinse coating may also be formed on the substrate. A non-rinse coating skips the final deionized water rinse after the conversion process is complete.

DETAILED DESCRIPTION

The chemical conversion coating solution of the present invention is preferably composed of potassium manganate, potassium hydroxide, potassium phosphate dibasic, potassium fluoride, sodium hydrosulfide and orthophosphoric acid. The coating solution may also be mixed with wetting agents such as sulfonates that enable uniform and continuous coating. In addition, the coating solution may also contain certain additives such as acetates and nitrates that activate the surface and control the rates of reaction. Chemical conversion takes place when a clean, smut-free hydrated, oxyhydroxide coated aluminum or aluminum alloy substrate is immersed within the chemical coating solution of the present invention. The metallic cations of the conversion solution substitute for the aluminum ions of the amorphous hydrated oxyhydroxide gel formed on the surface of the substrate, and also form a uniform coating of a hydrated precipitate.

During the substitution process metallic ions M(III) and M(VI) are substituted for the Al(III) ions in the gel. The M(III) substitution is believed to promote rapid hardening of the gel upon drying and impart mechanical strength. The substitution of M(VI) ions for a portion of the Al(III) ions in the gel may be responsible for providing the coating with significant corrosion resistance and the ability to self-heal when in contact with moisture. When metallic cations are substituted for the Al(III) ions in the coating, the conversion coating is expected to form a compressive residual stress state, water of hydration at the surface. The compressive residual stress state, water of hydration and the hydrophobic nature of the coating may contribute to the self-healing ability of the coating.

Substitutions can occur when there is a minimal difference in the size of the metallic ions relative to the aluminum ions. The Hume-Rothery rule allows for the substitution of ions (or atoms) when the ionic (atomic) radii do not differ by more than 15%, and when the coordination numbers of the respective ions remain the same. Table I illustrates the coordination numbers and radii of selected metallic cations in either a (III) or (VI) valence state that exhibit similar ionic radius compared to the Al(III) ion. Metallic cations that are either smaller or relatively the same size as that of Al(III) ions can be expected to exhibit a compressive, residual stress state at the surface of the aluminum alloy substrate.

TABLE I

| No. | Metallic Cation (Valence State) | Coordination Number(s) | Ionic Radius (Å) |
|---|---|---|---|
| 1 | Al(III) | 4, 6 | 0.39, 0.54 |
| 2 | Cr(III) | 6 | 0.62 |
| 3 | Cr(VI) | 4 | 0.26 |
| 4 | Ce(III) | 6, 8, 12 | 1.01, 1.14, 1.29 |
| 5 | Ga(III) | 4, 6 | 0.47, 0.62 |

TABLE I-continued

| No. | Metallic Cation (Valence State) | Coordination Number(s) | Ionic Radius (Å) |
|---|---|---|---|
| 6 | Mn(III) | 6 | 0.58 |
| 7 | Mn(VI) | 4 | 0.26 |
| 8 | Mo(VI) | 6, 7 | 0.59, 0.73 |
| 9 | Sc(III) | 6, 8, 12 | 0.745, 0.87, 1.116 |
| 10 | Se(VI) | 4, 6 | 0.50, 0.42 |
| 11 | Ti(III) | 6 | 0.67 |
| 12 | Te(III) | 6 | 0.56 |
| 13 | V(III) | 6 | 0.64 |
| 14 | W(VI) | 4, 6 | 0.42, 0.60 |

The preferred metal cation of the present invention is manganese. The Mn(III) and Mn(VI) ions closely match the ionic radii and the coordination numbers of the Al(III), Cr(III) and Cr(VI) ions and thus the manganese cations are a viable alternative to chromate in the conversion coating of aluminum and its alloys. The manganese cations can be formed in solution by adding potassium permanganate as [Mn(VIII)] or potasium manganate as [Mn(VI)], but potassium manganate delivers the best results and is preferred. Manganate is also preferred because it is relatively inexpensive and abundant.

In addition to manganese the other metal ions listed in Table I (except Cr) may also be used in the nonchromate conversion coating solution of the present invention. Chemicals that contain many of these metallic cations are inherently expensive and are impractical to use as an alternative to chromate in a conversion coating because of their cost. Metallic cations such as Ce(III),Sc(III) or Mo(VI) can be used but such a substitution requires a very long reaction (processing) time due to the large differences in size between Al(III) and the Ce(III), Sc(III) or Mo(VI) ions. Thus, manganese is preferred as it provides both Mn(III) and Mn(VI) cations. Although, the ionic radius of Mn(VI) is much smaller than that of Al(III), it is comparable to that of Cr(VI).

The present invention may be further understood from the tests that were performed as described in the EXAMPLES below. In each case, preliminary to the test, the aluminum alloy substrate was prepared following the standard practices as follows:

1. Immersion of the aluminum substrate in Turco 4215 Cleaner™ (52.2 g/l) for 30 minutes followed by a deionized (DI) water rinse. (Turco 4215 Cleaner™ is a tradename for a cleaner manufactured and sold by Turco Products Division of Purex Corporation, Wilmington, Calif.).
2. The aluminum substrate is then immersed in Turco Smut-Go™ (179 g/l) for 10 minutes followed by a DI water rinse. (Turco Smut-Go™ is a tradename for a cleaner manufactured and sold by Turco Products Division of Purex Corporation, Wilmington, Calif.).

EXAMPLE 1

Panels of 2024 aluminum alloy having dimensions of 7.5 by 10 cm were immersed in a potassium manganate bath in order to form a conversion coating. After the standard practices of steps one and two, the panels were either immersed in boiling deionized (DI) water for 5 minutes or not, depending on the experiment run. After the boiling DI water bath, the panels were immersed in various concentrations of potassium manganate for different lengths of time followed by a DI water rinse. Altogether 16 coatings were produced on 2024 aluminum alloy panels. Subsequently, additional coatings were produced on two sets of 6061 and 5052 aluminum alloy test panels having approximately the dimensions of 6.5 by 7.5 cm each. Following the completed conversion treatment the panels were exposed to ASTM B 117 salt fog corrosion testing for 24 hours. Table II provides a complete listing of the experimental conditions used and the corrosion testing results.

TABLE II

| Expt. Number | Coupon Number | Boiling Water Used | Manganate concentration* | Time in Manganate Bath | Final Dip in 50% HF | Salt Spray Results (No. of Pits) | Corrosion Rating Index** |
|---|---|---|---|---|---|---|---|
| 01 | 01-02 | yes | Low | 1 minute | yes | TNTC | 0/0 |
| 01 | 03-04 | yes | Low | 1 minute | no | 377/325 | 0/1 |
| 01 | 05-06 | no | Low | 1 minute | yes | TNTC | 0/0 |
| 01 | 07-08 | no | Low | 1 minute | no | 400/480 | 0/0 |
| 02 | 01-02 | yes | Low | 5 minutes | yes | TNTC | 0/0 |
| 02 | 03-04 | yes | Low | 5 minutes | no | TNTC | 0/0 |
| 02 | 05-06 | no | Low | 5 minutes | yes | TNTC | 0/0 |
| 02 | 07-08 | no | Low | 5 minutes | no | TNTC | 0/0 |
| 03 | 01-02 | yes | High | 1 minute | yes | TNTC | 0/0 |
| 03 | 03-04 | yes | High | 1 minute | no | 395/397 | 0/0 |
| 03 | 05-06 | no | High | 1 minute | yes | TNTC | 0/0 |
| 03 | 07-08 | no | High | 1 minute | no | 335/323 | 0/0 |
| 04 | 01-02 | yes | High | 5 minutes | yes | TNTC | 0/0 |
| 04 | 03-04 | yes | High | 5 minutes | no | 187/145 | 1/1 |
| 04 | 05-06 | no | High | 5 minutes | yes | TNTC | 0/0 |
| 04 | 07-08 | no | High | 5 minutes | no | 229/168 | 0/1 |
| 05 | 5052 Alloy | yes | Low | 1 minute | no | 228 | 2 |
| 05 | 5052 Alloy | yes | Low | 1 minute | no | 240 | 2 |
| 06 | 6061 Alloy | yes | Low | 1 minute | no | 301 | 1 |
| 06 | 6061 Alloy | yes | Low | 1 minute | no | 311 | 1 |

TNTC = too numerous to count.
*Composition of the manganate bath: "low" concentration = potassium manganate - 10 g/l; potassium hydroxide - 50 g/l; potassium phosphate dibasic - 17.5 g/l; and potassium fluoride - 17.5 g/l. "High" concentration = potassium manganate - 40 g/l; potassium hydroxide - 200 g/l; potassium phosphate dibasic - 70 g/l; and potassium fluoride - 70 g/l.
**Corrosion rating index based on ASTM D 1654; 0 = over 75% of surface corroded, while 10 = no corrosion observed. The conversion coatings were formed without the addition of $Al(OH)_3$ to the bath.

EXAMPLE 2

Standard steps one and two were performed to eight panels of 6061 aluminum alloy having the approximate dimensions of 6.5 by 7.5 cm. Subsequently, six out of eight panels of 6061 aluminum alloy were immersed in a DI boiling water bath. The test panels were either placed in the manganate bath directly from the boiling water bath, or air dried with a compressed air jet prior to immersion in the manganate bath. Only the low concentration potassium manganate bath (potassium manganate 10 g/l; potassium hydroxide 50 g/l; potassium phosphate dibasic 17.5 g/l; and potassium fluoride 17.5 g/l) was used because it was found to form coatings with the best corrosion resistance. Additionally, aluminum hydroxide dry gel [$Al(OH)_3$] was added at 15 g/l to the manganate solution. Following the completed conversion treatment the panels were exposed to ASTM B 117 salt fog corrosion testing for 24 hours. Table III provides a complete listing of the experimental conditions used and the corrosion testing results.

TABLE III

| Coupon Numbers | Manganate Bath Formulation | Boiling Water Used | Air Drying Used | Time in Manganate Bath | Salt Spray Results No. of Pits | Corrosion Rating Index* |
|---|---|---|---|---|---|---|
| N1 | 10 g/l, no $Al(OH)_3$ | no | no | 60 seconds | 341 | 3 |
| N2 | 10 g/l, no $Al(OH)_3$ | yes | no | 60 seconds | 308 | 3 |
| N3 | 10 g/l, no $Al(OH)_3$ | yes | yes | 60 seconds | 269 | 3 |
| N4 | 10 g/l, no $Al(OH)_3$ | yes | yes | 30 Seconds | 283 | 3 |
| A1 | 10 g/l, with $Al(OH)_3$ | no | yes | 60 seconds | 212 | 4 |
| A2 | 10 g/l, with $Al(OH)_3$ | yes | no | 60 seconds | 187 | 4 |

TABLE III-continued

| Coupon Numbers | Manganate Bath Formulation | Boiling Water Used | Air Drying Used | Time in Manganate Bath | Salt Spray Results No. of Pits | Corrosion Rating Index* |
|---|---|---|---|---|---|---|
| A3 | 10 g/l, with $Al(OH)_3$ | yes | yes | 60 seconds | 238 | 3 |
| A4 | 10 g/l, with $Al(OH)_3$ | yes | yes | 30 Seconds | 161 | 4 |

*Corrosion rating index based on ASTM D 1654; 0 = over 75% of surface corroded, while 10 = no corrosion observed.

EXAMPLE 3

Standard steps one and two were performed on seven panels of 2024 aluminum alloy having the approximate dimensions of 7.5 by 10 cm. Subsequently six out of seven panels of 2024 aluminum alloy were immersed in a DI boiling water bath. The test panels were either placed in the manganate bath after being dried in an oven for three minutes or air dried with a compressed air jet prior to immersion in the manganate bath. Only the low concentration potassium manganate bath (potassium manganate 10 g/l; potassium hydroxide 50 g/l; potassium phosphate dibasic 17.5 g/l; and potassium fluoride 17.5 g/l.) was used because it was found to provide the coatings with the best corrosion resistance. Additionally, aluminum hydroxide dry gel [$Al(OH)_3$] was added at 15 g/l to the manganate solution. Following the completed conversion treatment the panels were exposed to ASTM B 117 salt fog corrosion testing for 24 hours. Table IV provides a complete listing of the experimental conditions used ad the corrosion testing results.

TABLE IV

| Coupon Numbers | Manganate Bath | Boiling Water Used | Air or Oven Drying | Time in Manganate Bath | Salt Spray Results No. of Pits | Corrosion Rating Index* |
|---|---|---|---|---|---|---|
| 96-1950 | 10 g/l, with $Al(OH)_3$ | no | Air | 60 seconds | 396 | 3 |
| 96-1951 | 10 g/l, with $Al(OH)_3$ | no | Oven | 60 seconds | 495 | 2 |
| 96-1952 | 10 g/l, with $Al(OH)_3$ | no | Oven | 30 seconds | 515 | 2 |
| 96-1953 | 10 g/l, no $Al(OH)_3$ | no | Air | 60 seconds | TNTC | 0 |
| 96-1954 | 10 g/l, no $Al(OH)_3$ | no | Oven | 60 seconds | 460 | 2 |
| 96-1955 | 10 g/l, no $Al(OH)_3$ | no | Oven | 30 seconds | 450 | 2 |
| 96-1956 | No manganate used | yes | Oven | Control | TNTC | 0 |

TNTC = too numerous to count
*Corrosion rating index based on ASTM D 1654; 0 = over 75% of surface corroded, while 10 = no corrosion observed.

EXAMPLE 4

Panels of 6061 aluminum alloy having dimensions 7.5×10 cm were immersed in a solution containing 5 g of floutitanic acid and 5 g of alconox (alkyl aryl sulfonate) in 500 ml of DI water at ambient temperature for about 5 minutes followed by a DI water rinse. The panels were subsequently immersed for about 10 minutes in a solution containing 5 g of potassium manganate, 2 g of potassium fluoride, 2 g of potassium hydroxide, 4 g of sodium hydrosulfite ($Na_2S_2O_4$) and 40 ml of orthophosphoric ($H_3PO_4$) acid in 100 ml of DI water with the resulting solution having a measured pH of about 3.4. The panels were rinsed in DI water, allowed to air-dry and subsequently dried for 24 hours in an oven held at 100°F. The panels were then subjected to salt fog corrosion testing per ASTM B117 for 24 hours. Table V provides a complete listing of the experimental conditions used and the corrosion testing results.

TABLE V

| Coupon Numbers | Boiling Water Used | Time in Manganate | DI Water | Oven Drying | Salt Spray Results No. of Pits | Corrosion Rating Index* |
|---|---|---|---|---|---|---|
| 98-0043-P | No | 10 Minutes | Final Wash | Yes | None | 8 |
| 98-0044-P | No | 10 Minutes | Final Rinse | Yes | None | 10 |

*Corrosion rating index based on ASTM D 1654; 8 = over 0.01% corroded, while 10 = no corrosion observed

What is claimed is:

1. A method for applying a non-chromate conversion coating to an aluminum substrate, comprising:

(a) cleaning the aluminum substrate in a solution for removing organic contaminants and then rinsing the substrate;

(b) desmutting the cleaned aluminum substrate in a solution for removing surface oxides and then rinsing the substrate; and (c) applying a conversion coating to the aluminum substrate by immersing the substrate in a solution containing manganese cations and aluminum hydroxide gel, and then removing the substrate;

whereby manganese cations are used to form a chromium-free protective coating that alleviates serious health hazards and disposal problems while providing corrosion resistance, paint adhesion, and the ability to self-heal when scratched.

2. The method of claim 1, wherein the solution for removing organic contaminants includes alkaline soluble salts and inhibitors for protecting the aluminum from an alkaline solution created by the alkaline soluble salts.

3. The method of claim 1, wherein the solution for removing surface oxides is comprised of a deoxidizer selected from the group consisting of nitric acid, hydrofluoric acid, ferric salts, persulfates, and peroxides.

4. The method of claim 1, further comprising the step of drying the aluminum substrate after desmutting and before applying the conversion coating.

5. The method of claim 1, further including the step of drying the substrate after the substrate is removed from the solution containing manganese cations and aluminum hydroxide gel whereby a no-rinse coating is formed on the substrate.

6. The method of claim 1, further including the steps of:

(a) rinsing the substrate after the substrate is removed from the solution containing manganese cations and aluminum hydroxide gel; and then (b) sealing the substrate with a sealant.

7. The method of claim 1, wherein the step of rinsing the aluminum substrate is performed using deionized water.

8. The method of claim 1, wherein the solution containing manganese cations includes:

(a) about 8.0 to 12.0 g/l potassium manganate;

(b) about 40.0 to 60.0 g/l potassium hydroxide;

(c) about 15.0 to 20.0 g/l potassium phosphate dibasic;

(d) about 15.0 to 20.0 g/l potassium fluoride;

(e) about 10.0 to 20.0 g/l aluminum hydroxide; and (f) a wetting agent to promote uniform wetting.

9. A solution for forming a non-chromate conversion coating on an aluminum substrate comprising:

(a) about 8.0 to 12.0 g/l potassium manganate;

(b) about 40.0 to 60.0 g/l potassium hydroxide;

(c) about 15.0 to 20.0 g/l potassium phosphate dibasic; and (d) about 15.0 to 20.0 g/l potassium fluoride.

10. The solution of claim 9, further including about 10.0 to 20.0 g/l aluminum hydroxide.

11. The solution of claim 9, further including a wetting agent for uniform wetting of the aluminum substrate.

* * * * *

UNITED STATES PATENT AND TRADEMARK OFFICE

CERTIFICATE OF CORRECTION

PATENT NO. : 6,248,183 B1
DATED : June 19, 2001
INVENTOR(S) : Krishnaswamy Sampath It is certified that error appears in the above-identified patent and that said Letters Patent is hereby corrected as shown below:

Title page,
Item [75], Inventor, please change "Krishnaswamy Sampath, Jr." to read
-- Krishnaswamy Sampath --.

Signed and Sealed this

Third Day of September, 2002

*Attest:*

*Attesting Officer*

JAMES E. ROGAN
*Director of the United States Patent and Trademark Office*